US008892014B2

(12) United States Patent
Yokoyama

(10) Patent No.: US 8,892,014 B2
(45) Date of Patent: Nov. 18, 2014

(54) FIXING DEVICE INCLUDING MOVABLE PEELING PLATE

(75) Inventor: Shuji Yokoyama, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 701 days.

(21) Appl. No.: 13/161,300

(22) Filed: Jun. 15, 2011

(65) Prior Publication Data

US 2012/0003019 A1 Jan. 5, 2012

Related U.S. Application Data

(60) Provisional application No. 61/361,369, filed on Jul. 2, 2010.

(51) Int. Cl.
*G03G 15/20* (2006.01)

(52) U.S. Cl.
CPC ..... *G03G 15/2028* (2013.01); *G03G 15/2035* (2013.01)
USPC ..... 399/323

(58) Field of Classification Search
CPC ..... G03G 15/2035; G03G 15/2071; G03G 2215/00552
USPC ..... 399/323
See application file for complete search history.

(56) References Cited

U.S. PATENT DOCUMENTS

2010/0303521 A1* 12/2010 Ogawa et al. ..... 399/323

FOREIGN PATENT DOCUMENTS

JP 2009-098169 5/2009

* cited by examiner

*Primary Examiner* — David Gray
*Assistant Examiner* — Andrew V Do
(74) *Attorney, Agent, or Firm* — Patterson & Sheridan LLP

(57) ABSTRACT

According to one embodiment, a fixing device includes: an image-side rotating section to come into contact with an unfixed image on a recording medium; a pressing section to form a nip between the pressing section and the image-side rotating section; a pressing adjusting section to adjust pressing force between the image-side rotating section and the pressing section; and a peeling plate to move to a position during jam treatment if the pressing force is pressing force during the jam treatment and peel the recording medium off the image-side rotating section.

17 Claims, 6 Drawing Sheets

FIXING DEVICE INCLUDING MOVABLE PEELING PLATE

CROSS-REFERENCE TO RELATED APPLICATION

This application is based upon and claims the benefit of priority from Provisional U.S. Application 61/361,369 filed on Jul. 2, 2010, the entire contents of which are incorporated herein by reference.

FIELD

Embodiments described herein relate to a fixing device used in an image forming apparatus of an electrophotographic system and including a peeling plate.

BACKGROUND

As a fixing device used in an image forming apparatus such as a copying machine or a printer, there is a fixing device that causes a sheet to pass through a nip of a pair of rollers, which are heated and pressed to come into contact with each other, and heats, presses, and fuses an unfixed toner on the sheet to fix the toner on the sheet. This fixing device includes a peeling plate for peeling the sheet off one of the rollers after the fixing. In this fixing device, if the pressure of the pair of rollers is reduced in order to remove the sheet if a jam occurs, it is likely that the distal end of the peeling plate comes into contact with the roller. Therefore, there is a device that moves the peeling plate to a retracted position while being linked to the reduction of the pressure of the pair of rollers and prevents the distal end of the peeling plate from coming into contact with the roller.

However, during jam treatment, if the peeling plate is retracted from a peeling position, for example, if a user removes the sheet while rotating the pair of rollers, it is likely that the jammed sheet is not peeled off the roller, twines around the roller, and remains in the fixing device.

DETAILED DESCRIPTION

In general, according to one embodiment, a fixing device includes: an image-side rotating section to come into contact with an unfixed image on a recording medium; a pressing section to form a nip between the pressing section and the image-side rotating section; a pressing adjusting section to adjust pressing force between the image-side rotating section and the pressing section; and a peeling plate to move to a position during jam treatment if the pressing force is pressing force during the jam treatment and peel the recording medium off the image-side rotating section.

Embodiments are explained below.

Figure 1:
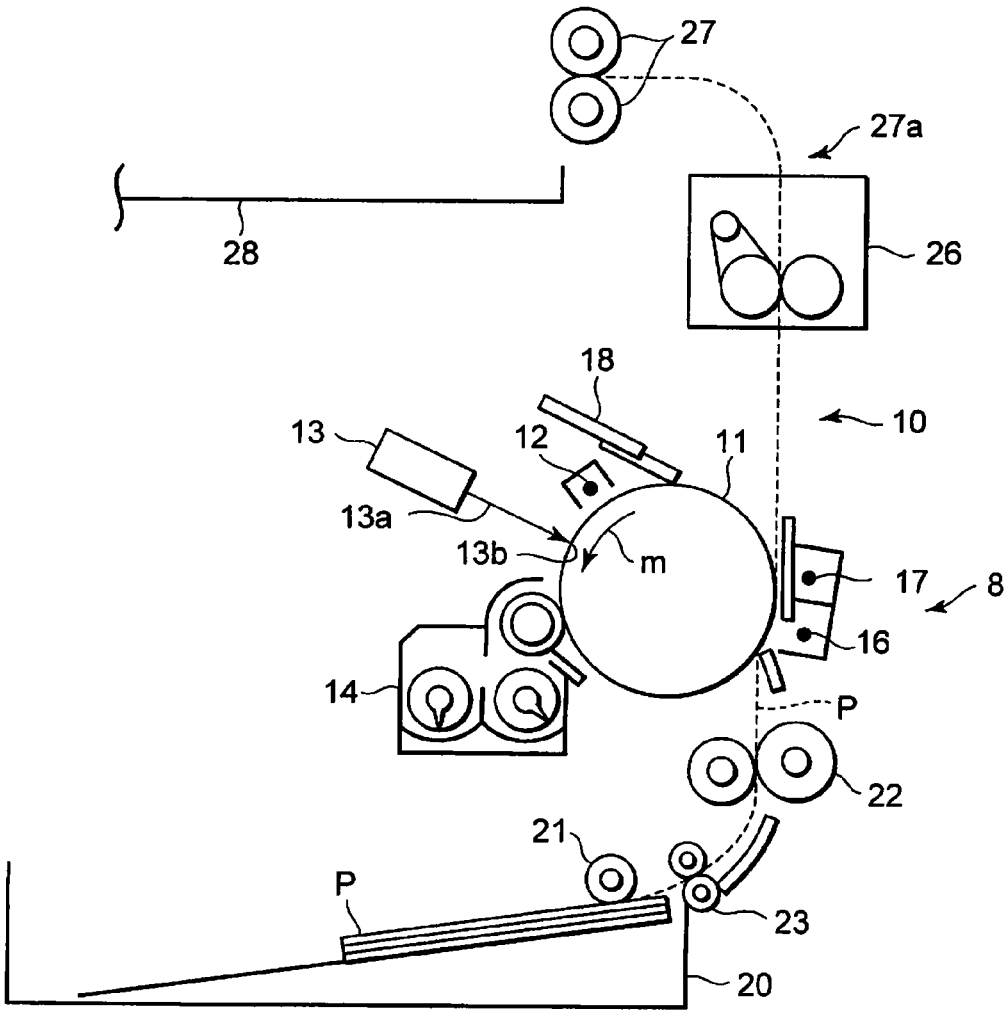
FIG. 1 is a schematic diagram of a main part of a printer according to an embodiment.

FIG. 1 shows a main part of a printer 10 as an image forming apparatus according to the embodiment. The printer 10 includes an image forming section 8 to form an unfixed toner image on a sheet P as a recording medium. The image forming section 8 includes, around a photoconductive drum 11 that rotates in an arrow m direction, a charger 12, an exposing device 13, a developing device 14, a transfer charger 16, a peeling charger 17, and a cleaner 18.

The charger 12 uniformly charges the photoconductive drum 11. The exposing device 13 irradiates, on the basis of image data or the like, a laser beam 13*a* on an exposing position 13*b* of the uniformly-charged photoconductive drum 11 and forms an electrostatic latent image on the photoconductive drum 11. The developing device 14 gives a toner to the electrostatic latent image on the photoconductive drum 11 and visualizes the electrostatic latent image.

The transfer charger 16 transfers a toner image formed on the photoconductive drum 11 onto the sheet P. The peeling charger 17 peels the sheet P, on which the toner image is transferred, off the photoconductive drum 11. The cleaner 18 cleans the toner remaining on the photoconductive drum 11 after the transfer. The sheet P is picked up from a paper feeding cassette 20 by a pickup roller 21. The sheet P picked up from the paper feeding cassette 20 is conveyed to a separation roller 23 and a registration roller 22 and reaches the transfer charger 16 in synchronization with the toner image formed on the photoconductive drum 11.

The printer 10 transfers, with the transfer charger 16, the toner image formed on the photoconductive drum 11 onto the sheet P. After the transfer ends, the printer 10 peels, with the peeling charger 17, the sheet P off the photoconductive drum 11. The printer 10 includes, further downstream than the peeling charger 17 in a conveying direction of the sheet P, a fixing unit 26 and a paper discharge roller 27 to discharge the sheet P after the fixing to a paper discharge section 28. The printer 10 includes, between the fixing unit 26 and the paper discharge roller 27, a sensor 27*a* to detect the sheet P. If timing that the sheet P reaches the sensor 27*a* is delayed, the sensor 27*a* detects a jam of the sheet P. After the leading end of the sheet P reaches the sensor 27*a*, if timing until the trailing end of the sheet P passes the sensor 27*a* is delayed, the sensor 27*a* detects a jam of the sheet P. The printer 10 fixes, with the fixing unit 26, the toner image on the sheet P and discharges, with the paper discharge roller 27, the sheet P to the paper discharge section 28.

Figure 2:
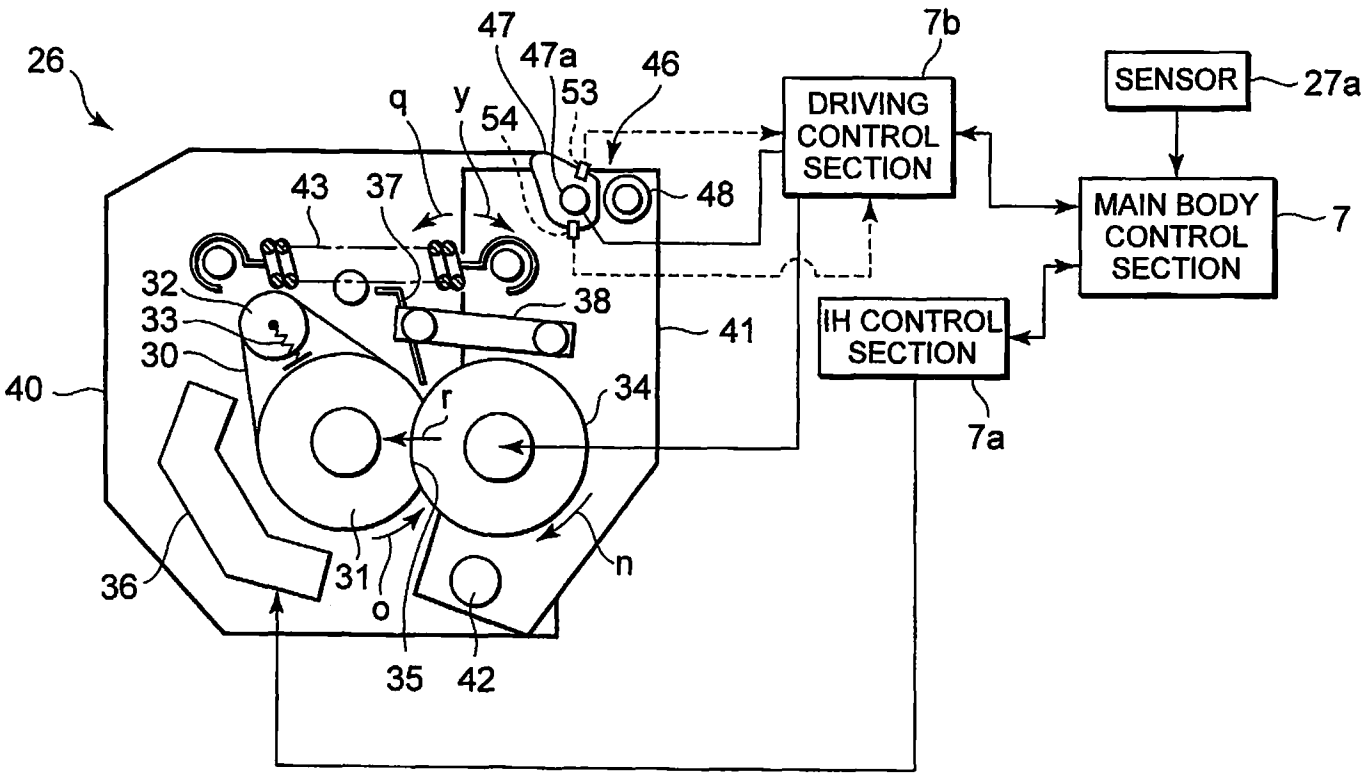
FIG. 2 is a schematic diagram of a fixing unit viewed from a side and a schematic control block diagram in which the fixing unit is mainly shown according to an embodiment.

The fixing unit 26 is explained in detail. As shown in FIG. 2, the fixing unit 26 includes a heat belt 30 as an image-side rotating section which contacts with a surface of the sheet P on which an unfixed toner image is formed, a pressing roller 34 as a pressing section, to form a nip 35 between the pressing roller 34 and the heat belt 30, an induction-current generating coil (hereinafter abbreviated as IH coil) 36 to cause the heat belt 30 to generate heat, and a peeling plate 37 to peel the sheet P off the heat belt 30. The structure of the image-side rotating section or the pressing section is not limited. For example, the image-side rotating section may be formed in a roller shape.

Figure 3:
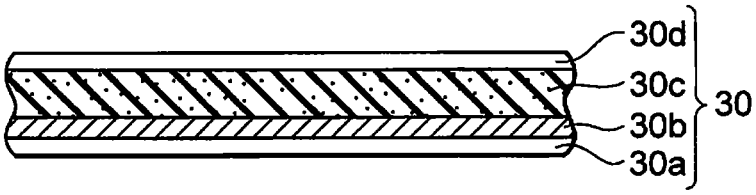
FIG. 3 is a schematic explanatory diagram of a layer configuration of a heat belt in the embodiment.

For example, as shown in FIG. 3, the heat belt 30 includes, on a supporting layer 30*a*, a heat generating layer 30*b*, a solid rubber layer 30*c*, and a release layer 30*d*. As the heat generating layer 30*b*, for example, nickel (Ni) having thickness of 40 μm is used. The heat generating layer 30*b* may be formed of stainless steel, aluminum (Al), a composite material of stainless steel and aluminum, or the like. The heat generating layer 30*b* is induction-heated by an induction current generated by the IH coil 36.

The heat belt 30 is supported by a supporting roller 31 and a tension roller 32. The supporting roller 31 includes a heat-resistant foamed rubber layer, for example, around a cored bar and includes a release layer of PFA on the surface of the supporting roller 31. The supporting roller 31 may include, for example, a jam treatment handle. A user may manually turn the jam treatment handle if a jam occurs and remove the jammed sheet P by rotating the heat belt 30. The tension roller 32 is formed by, for example, coating the surface of a metal pipe of aluminum with a release layer. The heat belt 30 is laid between the supporting roller 31 and the tension roller 32 at fixed tension by a tension mechanism 33 that acts on the tension roller 32.

For example, the pressing roller 34 includes a heat-resistant silicon sponge or silicon rubber layer, around a cored bar and includes a release layer of PFA on the surface of the pressing roller 34.

The fixing unit 26 includes a fixed frame 40 to support the heat belt 30 and a movable frame 41 to support the pressing roller 34. The movable frame 41 pivots with respect to the fixed frame 40 around a supporting shaft 42 provided in the fixed frame 40.

The fixed frame 40 pivotably supports the peeling plate 37. The peeling plate 37 links to a retraction link 38 provided in the movable frame 41. The peeling plate 37 pivots in association with the pivoting of the movable frame 41 around an attachment shaft 37*a*.

The fixing unit 26 includes a pressing spring 43 to rotate the movable frame 41 in an arrow q direction. The pressing roller 34 presses the heat belt 30 in an arrow r direction with spring force of the pressing spring 43. The fixing unit 26 includes a cam mechanism 46 to pivot the movable frame 41 in an arrow y direction against the spring force of the pressing spring 43. The fixed frame 40, the movable frame 41, the pressing spring 43, and the cam mechanism 46 configure a pressing adjusting section to adjust pressing force of the nip 35 between the heat belt 30 and the pressing roller 34.

Figure 4:
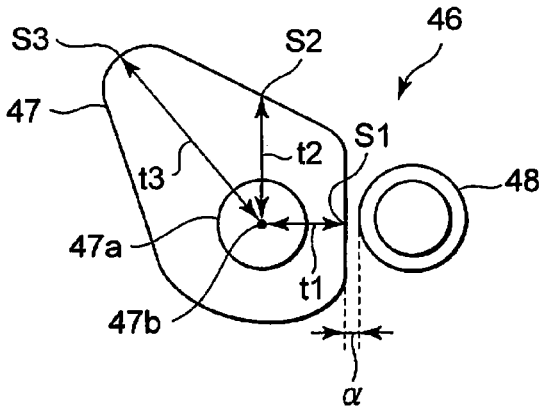
FIG. 4 is a schematic explanatory diagram of the position of a cam during pressing and contact in the embodiment.
Figure 5:
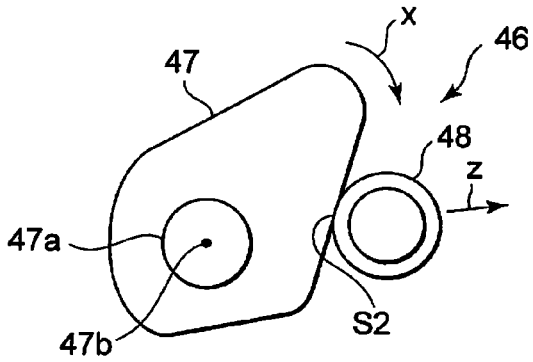
FIG. 5 is a schematic explanatory diagram of the position of the cam during jam treatment in the embodiment.
Figure 6:
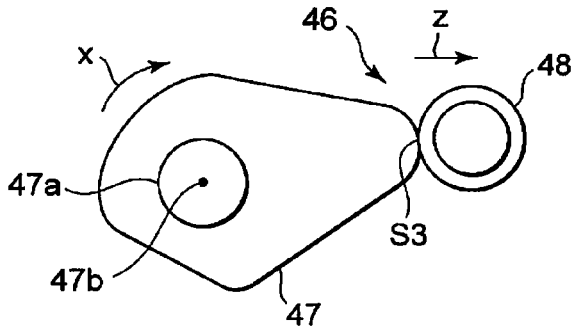
FIG. 6 is a schematic explanatory diagram of the position of the cam during keeping fuser temperature in the embodiment.

The cam mechanism 46 includes a cam 47 rotated by a cam shaft 47*a* provided in the fixed frame 40 and a cam follower 48 fixed to the movable frame 41. As shown in FIGS. 4 to 6, the cam 47 includes a first cam position S1, a second cam position S2, and a third cam position S3. The first cam position S1 is located at a distance t1 from a center 47*b* of the cam shaft 47*a*. The second cam position S2 is located at a distance t2 from the center 47*b* of the cam shaft 47*a*. The third cam position S3 is located at a distance t3 from the center 47*b* of the cam shaft 47*a*. The distances t1 to t3 have a relation t1<t2<t3.

As shown in FIG. 4, if the cam 47 is present in a position where the first cam position S1 is opposed to the cam follower 48, the cam 47 and the cam follower 48 have a space α between the cam 47 and the cam follower 48. A load by the cam follower 48 is not applied to the cam 47. The movable frame 41 obtains a rotating force in the arrow q direction with the spring force of the pressing spring 43. The spring force of the pressing spring 43 is not cancelled by the cam mechanism 46 and is applied entirely to the nip 35 via the movable frame 41. The pressing force of the nip 35 is first pressing force n1 during pressing and contact. During pressing and contact, since no load is applied to the cam 47, the first pressing force n1 applied to the nip 35 is set according to the spring force of the pressing spring 43. Therefore, by optimally setting the spring force of the pressing spring 43, during pressing and contact, the first pressing force n1 optimum for fixing can be applied to the nip 35. By not applying a load to the cam 47, the fixing unit 26 obtains stable fixing performance.

If the cam 47 is rotated in an arrow x direction and, as shown in FIG. 5, the cam 47 is present in a position where the second cam position S2 is opposed to the cam follower 48, the cam follower 48 is pushed in an arrow z direction by the cam 47. The movable frame 41 rotates in the arrow y direction against the spring force of the pressing spring 43. At this point, the pressing force of the nip 35 is second pressing force n2 during jam treatment.

If the cam 47 is further rotated in the arrow x direction and, as shown in FIG. 6, the cam 47 is present in a position where the third cam position S3 is opposed to the cam follower 48, the cam follower 48 is further pushed in the arrow z direction by the cam 47. The movable frame 41 further rotates in the arrow y direction against the spring force of the pressing spring 43. At this point, the pressing force of the nip 35 is third pressing force n3 during keeping fuser temperature.

The structure of the cam mechanism is not limited. For example, a cam position for separation may be formed in the cam to completely separate the pressing roller 34 from the heat belt 30 if the printer 10 stops.

During pressing and contact, the fixing unit 26 is performing fixing. In order to secure fixing performance, it is necessary to apply the sufficient first pressing force n1 to the nip 35. During jam treatment, in order to improve operability of the jam treatment, it is desirable to reduce the pressing force of the nip 35 to be smaller than the first pressing force n1. However, if the pressing force of the nip 35 is reduced to zero during the jam treatment, it is likely that the jammed sheet P, on which an unfixed toner image is formed, supported by the nip 35 drops. Therefore, during the jam treatment, as the pressing force of the nip 35, the second pressing force n2 smaller than the first pressing force n1 and enough for keeping the sheet P in the nip 35 is necessary.

In this embodiment in which the IH coil 36 is provided on the outside of the heat belt 30, for example, during keeping fuser temperature of the heat belt 30 in a ready mode of the printer 10, the rotation of the heat belt 30 is essential in order to keep the temperature of the heat belt 30 at ready temperature. However, to realize extension of the life of the heat belt 30, the supporting roller 31, the pressing roller 34, or the like, it is desirable to set the pressing force of the nip 35 during the keeping fuser temperature as low as possible. During the keeping fuser temperature, the pressing force of the nip 35 may be zero. Therefore, the pressing force of the nip 35 during the keeping fuser temperature only has to be the third pressing force n3 smaller than the second pressing force n2 and enough for allowing the heat belt 30 to rotate driven to the rotation of the pressing roller 34. The pressing forces n1 to n3 include a relation n1>n2>n3.

Furthermore if a power of the printer 10 turned off, it is desirable to reduce the pressing force of the nip 35, in a same way as during the keeping fuser temperature. If the power of the printer 10 turned off, the fixing unit 26 is not heated. However during the power of the printer 10 turned off, if the pressing force of the nip 35 is reduced, loads to the supporting roller 31 and the pressing roller 34 are decreased. If the pressing force of the nip 35 is reduced, it is advantages to long life of the supporting roller 31 and the pressing roller 34. And the reduction of the pressing force of the nip 35 prevents creeps of the supporting roller 31 and the pressing roller 34.

Figure 7:
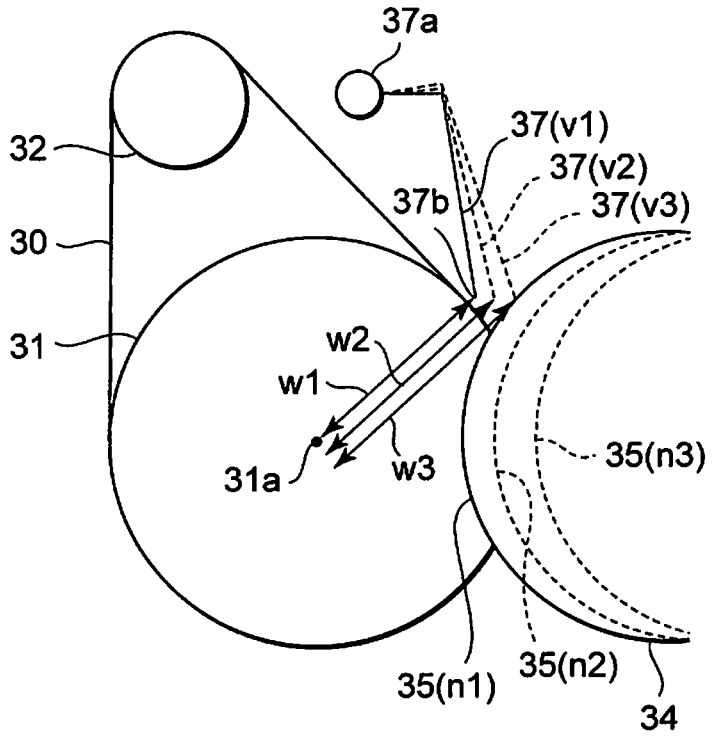
FIG. 7 is a schematic explanatory diagram of the movement of a peeling plate following the rotation of the cam in the embodiment.

The movement of the peeling plate 37 linked to the movable frame 41 is explained below. During pressing and contact of the fixing unit 26, the peeling plate 37 is present in a fixing and peeling position v1 indicated by a solid line in FIG. 7. During jam treatment of the fixing unit 26, the peeling plate 37 is present in a jam and peeling position v2 indicated by a dotted line in FIG. 7. During keeping fuser temperature of the fixing unit 26, the peeling plate 37 is present in a separated position v3 indicated by an alternate long and short dash line in FIG. 7.

In the fixing and peeling position v1, a distal end 37*b* of the peeling plate 37 is present at a distance w1 from a center 31*a* of the supporting roller 31. In the jam and peeling position v2, the distal end 37*b* of the peeling plate 37 is present at a distance w2 from the center 31*a* of the supporting roller 31. In the separated position v3, the distal end 37*b* of the peeling plate 37 is present at a distance w3 from the center 31*a* of the supporting roller 31. The distances w1 to w3 include a relation w1<w2<w3. The center 31*a* of the supporting roller 31 is set as a rotation reference of the heat belt 30.

The distal end 37*b* of the peeling plate 37 present in the fixing and peeling position v1 during pressing and contact is opposed to the heat belt 30 laid along the supporting roller 31 that is dented by the first pressing force n1. If the pressing force of the nip 35 is reduced to the second pressing force n2 during jam treatment, the dented supporting roller 31 is restored. Therefore, the distal end 37*b* of the peeling plate 37 present in the jam and peeling position v2 does not come into contact with the heat belt 30 laid along the restored supporting roller 31 and approaches the heat belt 30 laid along the restored supporting roller 31 to surely peel the jammed sheet P off the heat belt 30. If the pressing force of the nip 35 is further reduced to the third pressing force n3, the distal end 37*b* of the peeling plate 37 present in the separated position v3 is located to be surely separated from the heat belt 30 laid along the further restored supporting roller 31.

Therefore, if the distal end 37*b* of the peeling plate 37 is present in the fixing and peeling position v1 or the jam and peeling position v2, the distal end 37*b* approaches the heat belt 30 in the position. If the distal end 37*b* of the peeling plate 37 is present in the fixing and peeling position v1 or the jam and peeling position v2, the distal end 37*b* keeps a gap between the distal end 37*b* and the heat belt 30 at, for example, 0.1 mm to 0.4 mm.

Figure 8:
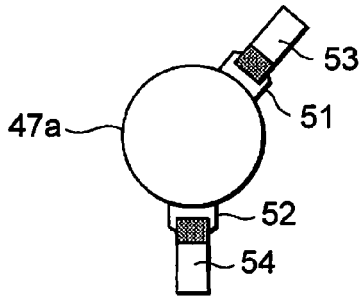
FIG. 8 is a schematic explanatory diagram of first and second rotor positions during pressing and contact in the embodiment.
Figure 9:
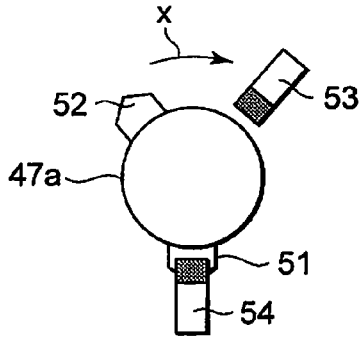
FIG. 9 is a schematic explanatory diagram of first and second rotor positions during jam treatment in the embodiment.
Figure 10:
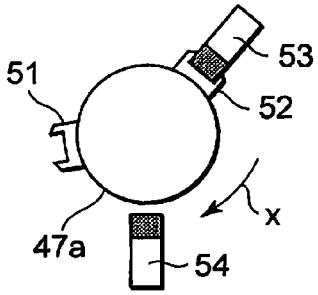
FIG. 10 is a schematic explanatory diagram of first and second rotor positions during keeping fuser temperature in the embodiment.

As shown in FIGS. 8 to 10, the cam shaft 47*a* of the cam 47 includes a first rotor 51 and a second rotor 52 that are markers and have different shapes. For example, the first rotor 51 or the second rotor 52 is detected by a first photosensor 53 and a second photosensor 54, the cam 47 is stopped, and the pressing force of the nip 35 is set. For example, as shown in FIG. 8, the cam 47 is stopped if the first photosensor 53 detects the first rotor 51 and the second photosensor 54 detects the second rotor 52. The cam 47 is present in the position where the first cam position S1 is opposed to the cam follower 48 and the cam 47 sets the pressing force of the nip 35 to the first pressing force n1 during pressing and contact. The cam 47 is rotated in the arrow x direction and, as shown in FIG. 9, if the second photosensor 54 detects the first rotor 51, the cam 47 is stopped. The cam 47 is present in the position where the second cam position S2 is opposed to the cam follower 48 and the cam 47 sets the pressing force of the nip 35 to the second pressing force n2 during jam treatment. The cam 47 is further rotated in the arrow x direction and, as shown in FIG. 10, if the first photosensor 53 detects the second rotor 52, the cam 47 is stopped. The cam 47 is present in the position where the third cam position S3 is opposed to the cam follower 48 and the cam 47 sets the pressing force of the nip 35 to the third pressing force n3 during keeping fuser temperature.

The fixing unit 26 includes an IH control section 7*a* and a driving control section 7*b* controlled by a main body control section 7 to control the entire printer 10. The IH control section 7*a* controls a high-frequency current applied to the IH coil 36. The driving control section 7*b* controls rotation driving of the pressing roller 34. Further, the driving control section 7*b* controls rotation driving of the cam 47 using detection results of the first photosensor 53 and the second photosensor 54.

For example, if the printer 10 is in the ready mode, the driving control section 7*b* stops the rotation of the cam 47 in a position where the first photosensor 53 detects the second rotor 52. At this point, the cam 47 is present in the position where the third cam position S3 is opposed to the cam follower 48. Therefore, the movable frame 41 pivots in the arrow y direction against the spring force of the pressing spring 43. The third pressing force n3 during keeping fuser temperature is applied to the nip 35. The peeling plate 37 moves to the separated position v3 while being linked to the pivoting of the movable frame 41 by the retraction link 38 and is separated from the heat belt 30.

In a state in which the pressing force applied to the nip 35 is kept at the third pressing force n3, the driving control section 7*b* drives to rotate the pressing roller 34. The IH control section 7*a* applies a high-frequency current during keeping fuser temperature to the IH coil 36. If the driving control section 7*b* rotates the pressing roller 34 in an arrow n direction, the heat belt 30 rotates in an arrow o direction driven to the pressing roller 34. Therefore, while the heat belt 30 rotates in the arrow o direction, the heat belt 30 generates heat with a magnetic flux generated by the IH coil 36 and maintains the temperature of the heat belt 30 at the ready temperature.

If the print operation is started and the printer 10 changes to a print mode, the driving control section 7*b* rotates the cam 47 in the arrow x direction. The driving control section 7*b* stops the rotation of the cam 47 in a position where the first photosensor 53 detects the first roller 51 and the second photosensor 54 detects the second rotor 52. At this point, the cam 47 is present in a position where the first cam position S1 is opposed to the cam follower 48 to be spaced the space α from the cam follower 48. Therefore, no load is applied to the cam 47 and the movable frame 41 pivots in the arrow q direction with the spring force of the pressing spring 43. The first pressing force n1 during pressing and contact is applied to the nip 35. The peeling plate 37 moves to the fixing and peeling position v1 while being linked to the pivoting of the movable frame 41.

In a state in which the pressing force applied to the nip 35 is kept at the first pressing force n1, the driving control section 7*b* drives to rotate the pressing roller 34. The IH control section 7*a* applies a high-frequency current for maintaining fixing temperature to the IH coil 36. The heat belt 30 is driven to rotate in the arrow o direction following the rotation in the arrow n direction of the pressing roller 34. Therefore, while the heat belt 30 rotates in the arrow o direction, the heat belt 30 generates heat with a magnetic flux generated by the IH coil 36 and maintains the fixing temperature. The fixing unit 26 fixes a toner image on the sheet P while the sheet P passes the nip 35. If the leading end of the sheet P passes through the nip 35, the distal end 37*b* of the peeling plate 37 present in the fixing and peeling position v1 peels the sheet P off the heat belt. The sheet P that finishes passing the peeling plate 37 is discharged to the paper discharge section 28 by the paper discharge roller 27.

If a jam occurs during print operation, the sensor 27*a* detects that the sheet P jams and inputs a detection result to the main body control section 7. The printer changes to a jam treatment mode and displays the occurrence of the jam on a display panel. The main body control section 7 controls to stop the print operation. The IH control section 7*a* immediately stops the application of the high-frequency current to the IH coil 36. The driving control section 7*b* stops the pressing roller 34.

If the printer 10 changes to the jam treatment mode, the driving control section 7*b* rotates the cam 47 in the arrow x direction. The driving control section 7*b* stops the rotation of the cam 47 in a position where the second photosensor 54 detects the first rotor 51. At this point, the cam 47 is present in the position where the second cam position S2 is opposed to the cam follower 48. Therefore, the movable frame 41 pivots in the arrow y direction against the spring force of the pressing spring 43. The second pressing force n2 during jam treatment is applied to the nip 35. The peeling plate 37 moves to the jam and peeling position v2 while being linked to the pivoting of the movable frame 41.

Since the pressing force applied to the nip 35 is reduced to the second pressing force n2, force for holding the sheet P of the nip 35 decreases or the supporting roller 31 is easily rotated and jam treatment can be easily performed. Moreover, the second pressing force n2 enables the nip 35 to hold the jam sheet p. Therefore, it is possible to prevent the jammed sheet P having an unfixed toner image from passing through the nip 35 and dropping into the apparatus body.

For example, if the user rotates the supporting roller 31 using the manual jam treatment handle to thereby rotate the heat belt 30 and remove the jammed sheet P, the peeling plate 37 present in the jam and peeling position v2 surely peels the jammed sheet P off the heat belt 30. Therefore, the jammed sheet P is prevented from being rolled in the heat belt 30 and remaining in the fixing unit 26.

After the jam treatment ends, the printer 10 returns to the print mode and resumes the print operation. According to the resumption of the print operation, the first cam position S1 of the cam 47 is kept in the position opposed to the cam follower 48. The fixing unit 26 keeps the pressing force applied to the nip 35 at the first pressing force n1. The peeling plate 37 moves to the fixing and peeling position v1 and resumes the fixing operation.

According to this embodiment, the pressing force applied to the nip 35 between the heat belt 30 and the pressing roller 34 is changed during pressing and contact, during jam treatment, and during keeping fuser temperature. The peeling plate 37 is moved to the fixing and peeling position v1, the jam and peeling position v2, and the separated position v3 while being linked to the pressing force applied to the nip 35. During the pressing and contact, satisfactory fixing performance is obtained and the peeling plate 37 surely peels the sheet P off the heat belt 30. During the jam treatment, the jammed sheet P can be removed without dropping the jammed sheet P having an unfixed toner image into the apparatus body. If the heat belt 30 is rotated to perform jam treatment, the peeling plate 37 surely peels the jammed sheet P off the heat belt 30 and prevents the heat belt 30 from rolling in the jammed sheet P.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A fixing device comprising:
- an image-side rotating section configured to come into contact with an unfixed image on a recording medium;
- a pressing section configured to form a nip with the image-side rotating section;
- a pressing adjusting section configured to adjust a pressing force between the image-side rotating section and the pressing section; and
- a peeling plate configured to peel the recording medium off the image-side rotating section, and configured to move to a first distance from a rotation reference of the image-side rotating section during a pressing operation, a second distance further away from the rotation reference than the first distance during a jam treatment operation, and a third distance further away from the rotation reference than the second distance during a maintaining fuser temperature operation.

2. The device according to claim 1, wherein a position of the peeling plate is associated with the pressing force.

3. The device according to claim 1, wherein the peeling plate moves further away from the rotation reference of the image-side rotating section as the pressing, force decreases.

4. The device according to claim 1, wherein
- the pressing adjusting section adjusts the pressing force between the image-side rotating section and the pressing section depending on whether the fixing device is being subject to the pressing operation, the jam treatment operation, or the maintaining fuser temperature operation, and
- the peeling plate moves in association with adjustments by the pressing adjusting section.

5. The device according to claim 1, wherein the pressing adjusting section includes:
- an image-side supporting member to support the image-side rotating section;
- a pressing supporting member to support the pressing section and rotatably attached to the image-side supporting member; and
- a cam section to adjust a rotating amount between the image-side supporting member and the pressing supporting member.

6. The device according to claim 5, wherein the cam section includes:
- a cam follower positioned on the pressing supporting member; and
- a cam comprising a first cam position opposed to the cam follower during the pressing operation, a second cam position opposed to the cam follower during the jam treatment operation, and a third cam position opposed to the cam follower during the maintaining fuser temperature operation.

7. The device according to claim 6, wherein, if the first cam position is opposed to the cam follower, the cam does not receive a load from the cam follower.

8. The device according to claim 7, wherein the cam includes a marker in a cam shaft and detects a position of the marker to adjust rotation of the cam.

9. An image forming apparatus comprising:

an image forming section to form an unfixed image on a recording medium;

an image-side rotating section configured to come into contact with an unfixed image on a recording medium;

a pressing section configured to form a nip with the image-side rotating section;

a pressing adjusting section configured to adjust a pressing force between the image-side rotating section and the pressing section; and a peeling plate configured to peel the recording medium off the image-side rotating section, and configured to move to a first distance from a rotation reference of the image-side rotating section during a pressing operation, a second distance further away from the rotation reference than the first distance during a jam treatment operation, and a third distance further away from the rotation reference than the second distance during a maintaining fuser temperature operation.

10. The apparatus according to claim 9, wherein a position of the peeling plate is associated with the pressing force.

11. The apparatus according to claim 9, wherein the peeling plate moves further away from the rotation reference of the image-side rotating section as the pressing force decreases.

12. The apparatus according to claim 9, wherein the pressing adjusting section adjusts the pressing force between the image-side rotating section and the pressing section depending on whether the fixing device is being subject to the pressing operation, the jam treatment operation, or the maintaining fuser temperature operation, and the peeling plate moves in association with adjustments by the pressing adjusting section.

13. The apparatus according to claim 9, wherein the pressing adjusting section includes:

an image-side supporting member to support the image-side rotating section;

a pressing supporting member to support the pressing section and rotatably attached to the image-side supporting member; and a cam section to adjust a rotating amount between the age-side supporting member and the pressing supporting member.

14. The apparatus according to claim 13, wherein the cam section includes:

a cam follower positioned on the pressing supporting member; and a cam comprising a first cam position opposed to the cam follower during the pressing operation, a second cam position opposed to the cam follower during the jam treatment operation, and a third cam position opposed to the cam follower during the maintaining fuser temperature operation.

15. The apparatus according to claim 14, wherein, if the first cam position is opposed to the cam follower, the cam does not receive a load from the cam follower.

16. The apparatus according to claim 14, wherein the cam includes a marker in a cam shaft and detects a position of the marker to adjust rotation of the cam.

17. A fixing method comprising:

adjusting a pressing force between an image-side rotating member and a pressing member during a jam treatment operation;

moving, when adjusting the pressing force during the jam treatment operation, a peeling plate to a jam treatment position, the peeling plate being further movable to a first distance closer to a rotation reference of the image-side rotating section than the jam treatment position during a pressing operation, and a third distance further away from the rotation reference than the jam treatment position during a maintaining fuser temperature operation; and peeling, during the jam treatment operation, a recording medium off the image-side rotating section using the peeling plate.

* * * * *